United States Patent [19]

Lax

[11] Patent Number: 4,717,350

[45] Date of Patent: Jan. 5, 1988

[54] MULTIPLE OUTLET STRIP WITH INTEGRAL GROUNDING OF OTHER EQUIPMENT

[75] Inventor: Jonathan R. Lax, Langhorne, Pa.

[73] Assignee: Voyager Technologies, Inc., Langhorne, Pa.

[21] Appl. No.: 883,939

[22] Filed: Jul. 10, 1986

[51] Int. Cl.[4] ..... H01R 13/652

[52] U.S. Cl. ..... 439/92; 439/488; 439/620

[58] Field of Search ..... 339/14 R, 14 L, 113 R, 339/113 L, 147 R; 439/92, 95, 620, 488

[56] References Cited

U.S. PATENT DOCUMENTS

| | | | |
|---|---|---|---|
| 3,120,414 | 2/1964 | Farish | 339/14 R |
| 3,586,911 | 6/1971 | Kraus . | |
| 3,824,477 | 7/1974 | Cotton . | |
| 4,072,401 | 2/1978 | Instone . | |
| 4,111,516 | 9/1978 | Wireman | 339/113 R |
| 4,113,334 | 9/1978 | Instone . | |
| 4,384,758 | 5/1983 | Lee et al. . | |
| 4,427,252 | 1/1984 | Lee et al. . | |
| 4,468,083 | 8/1984 | Lee et al. . | |
| 4,493,515 | 1/1985 | Banks . | |

FOREIGN PATENT DOCUMENTS

| | | | |
|---|---|---|---|
| 1576607 | 10/1980 | United Kingdom | 339/147 R |

*Primary Examiner*—Eugene F. Desmond

*Attorney, Agent, or Firm*—Nixon & Vanderhye

[57] ABSTRACT

A multiple electrical outlet strip also includes jacks for connection of accessory electrical devices to ground. A banana-type jack, or other suitable socket, is accessible from outside the casing of the multiple electrical outlet strip, and is electrically connected to a ground lead within the casing. A number of electrical receptacles are mounted by the casing, also accessible from outside the casing, and have live, neutral and ground terminals, all connected to a three wire conductor for carrying electrical current to the casing. Circuitry also may be mounted within the casing, connected to the ground lead, for sensing continuity to ground. A circuit breaker may be provided for selectively allowing or interrupting the supply of current from the three wire conductor to the receptacles within the casing.

19 Claims, 2 Drawing Figures

MULTIPLE OUTLET STRIP WITH INTEGRAL GROUNDING OF OTHER EQUIPMENT

BACKGROUND AND SUMMARY OF THE INVENTION

Multiple electrical outlet strips have become widely used, and versatile electrical products, employed in a wide variety of home, industrial, and commercial settings. In a number of settings in which such components are utilized, it has also been found that it is desirable to provide an electrical device which performs an electrical grounding function.

According to the present invention, it has been recognized that it is desirable to provide for the grounding of accessory equipment utilizing a multiple electrical outlet strip. By providing at least one ground jack in a conventional multiple electrical outlet strip, according to the invention the multiple electrical outlet strip becomes an even more versatile piece of equipment, and eliminates the need for accessory grounding devices in environments in which it is utilized.

According to the one aspect of the present invention, a multiple electrical outlet strip is provided which comprises: A casing having a top with a number of apertures formed therein, inside and end walls to enclose a space, and an open side opposite the top, there being a cover to complete the enclosure of the space inside the casing. A plurality of electrical outlet receptacles having live, neutral and ground terminals, the receptacles being adapted to be connected together into a parallel circuit. Each receptacle being received within an aperture in the casing top and having openings on one side thereof that are exposed on the outside of the casing for receiving two and three prong electrical plugs for connection to the terminals. A three wire conductor for carrying an electrical current to the casing, the connector having live, neutral and ground leads. And, a plurality of ground jacks, distinct from the connectors, the ground jacks being accessible from the exterior of the casing for receipt of a ground connector, and the ground jacks operatively connected, within the casing, to the ground lead from the three wire conductor.

The ground jacks may be of any suitable construction, such as a banana-type jack. Additionally, it may be desirable to provide circuitry means within the casing, the circuitry means operatively connected to the ground jacks and the receptacles for sensing continuity to ground. Also, it can be desirable to provide a circuit breaker associated with the casing for selectively interrupting or allowing the supply of electrical current to the casing components from the three wire conductor.

It is the primary object of the present invention to provide a more versatile multiple electrical outlet strip. This and other objects of the invention will become clear from an inspection of the detailed description of the invention, and from the appended claims.

DETAILED DESCRIPTION OF THE DRAWINGS

Figure 1:
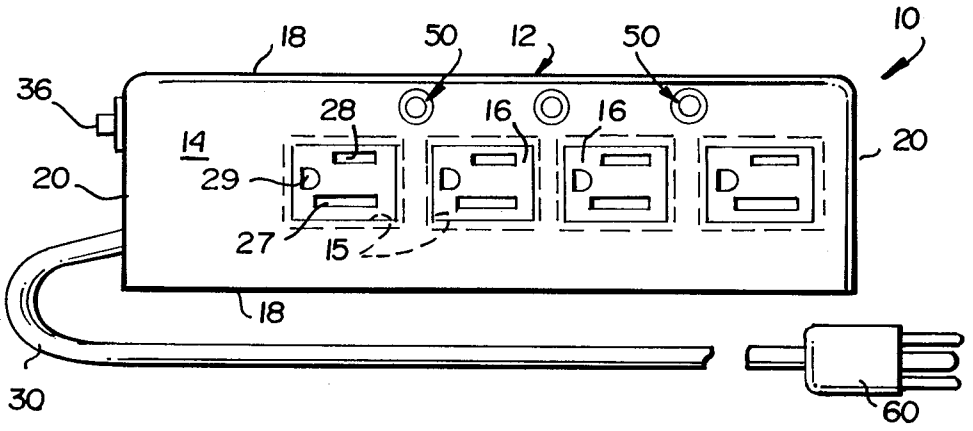
FIG. 1 is a top plan view of an exemplary multiple electrical outlet strip according to the present invention.
Figure 2:
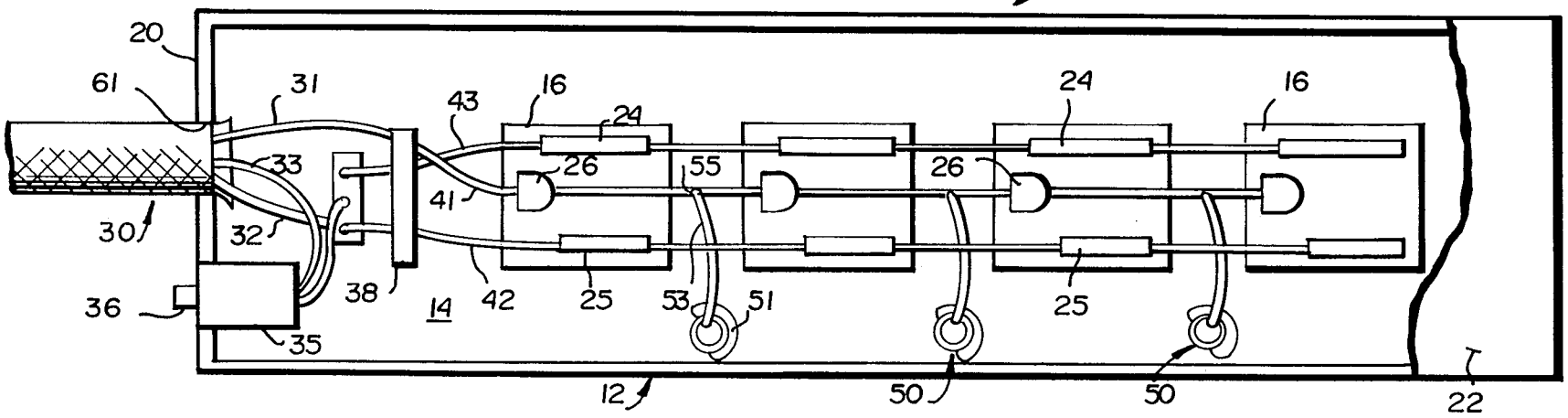
FIG. 2 is a bottom view, with the majority of the cover cut away for clarity of illustration, of the multiple electrical outlet strip of FIG. 1.

An exemplary multiple electrical outlet strip according to the present invention is illustrated generally by reference numeral 10 in FIGS. 1 and 2. The device 10 includes as a major component thereof a casing 12. The casing 12 has a top 14 with a plurality of apertures 15 disposed therein, each aperture for receipt of an electrical outlet receptacle 16. The casing 12, in addition to having the top 14, comprises closed sidewalls 18, and closed end walls 20, with an open bottom, as illustrated in FIG. 2, with the bottom normally being closed by a cover 22 during actual use of the device 10.

Each of the receptacles 16 comprises an insulating body having live, neutral, and ground terminals 24, 25, 26, respectively, associated with each. The receptacles are mounted within the apertures 15 of the casing top 14 so that openings 27, 28, 29, corresponding to the terminals 24, 25, 26, respectively, are accessible from the outside of the casing, being exposed for receipt of two and three pronged electrical plugs for connection to the terminals. Typical constructions of such multiple electrical outlet strips, and the manner in which they are connected within the casing, are illustrated in U.S. Pat. Nos. 4,072,401; 4,113,334; and 4,493,515. However any conventional construction of such components may be utilized.

The device 10 also includes a three wire conductor, shown generally by reference numeral 30, and having a ground lead 31, a neutral lead 32, and a live lead 33. The conductor 30 is operatively connected to the electrical receptacles 16. In the embodiment illustrated in FIG. 2, this is accomplished through a conventional circuit breaker 35 which has an actuator 36 exterior of the casing 12, and circuitry means 38. Ultimately, the wires 31, 32, 33 are connected to the wires 41, 42, 43, respectively, which connect the receptacles 16 in parallel.

According to the present invention, at least one ground connector is provided, distinct from the receptacles 16, for grounding an accessory electrical device not plugged into a receptacle 16. In the preferred embodiment illustrated in the drawings, a plurality of jacks 50 are provided, extending through apertures in the top 14 of the casing 12, adjacent one or more of the apertures 15 for the receptacles 16. The jacks 50 may be any conventional type of jack, such as an RCA type banana jack, or the banana-type sockets such as illustrated in U.S. Pat. Nos. 4,384,758, 4,427,252; or 4,468,083. The jacks 50 may be mounted so that they are accessible from the exterior of the casing 12, by any suitable mechanism. For instance they could be screw threaded into the apertures in the casing top 14, or could be held in place by spring clips, such as the spring clip illustrated schematically at 51 in FIG. 2.

Each of the jacks 50 is operatively connected to the ground wire 41, which in turn is operatively connected to the ground lead 31 of the conductor 30. Connection of each jack 50 to the ground wire 41 is simply accomplished utilizing a wire 53 which is connected (e.g. by soldering) to the jack 50, at one end thereof, and connected (e.g. by coiling, wrapping, and/or soldering) at the other end 55 thereof to the wire 41.

The circuitry 38, which is mounted within the casing 12 by any suitable means, such as a bracket connected to the bottom of the top 14, is circuitry for sensing continuity to ground. Any desirable conventional circuitry for sensing continuity to ground may be utilized. Conventional types of ground sensing circuitry are disclosed, for example, in U.S. Pat. No. 3,586,911 and 3,824,477.

It is desirable, to facilitate versatile use of the multiple electrical outlet strip 10, to connect the three wire conductor 30 at the end thereof remote from the casing 12 to a conventional three pronged electrical plug 60. The conductor 30 passes through an opening 61 formed in the end wall 20 of the casing 12, and can be properly held in place in that opening utilizing a grommet, or by a wide variety of other conventional techniques.

The device 10 according to the invention is thus very versatile, and readily utilizable to perform a number of different functions. The user merely plugs in the plug 60 to an electrical wall outlet, and then can plug in any desired two or three pronged plugs into the receptacle 16. If a piece of equipment merely needs to be grounded, an electrical connector associated with that equipment, which is compatible with a jack 50, is merely inserted into the jack 50. Different types of jacks 50 could be provided on the same unit 10 to accommodate different types of conventional electrical connectors for connection to ground. If for any reason continuity to ground should be interrupted, that will be sensed by the circuitry 38 and the entire unit cut off. If desired an indicator light can be provided to indicate on and off, or "tripped", condition of the device 10.

While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and devices.

What is claimed is:

1. A multiple electrical outlet strip comprising:

a plurality of electrical outlet receptacles, having live, neutral and ground terminals, the terminals of the electrical outlet receptacles being adapted to be connected into a parallel circuit;

a three wire conductor for carrying an electrical current to the outlet receptacles, the conductor having live, neutral and ground leads;

a casing having a top with apertures therein for receipt of said receptacles, and side and end walls to enclose a space into which the receptacles extend from the top, the casing having an open side opposite the top and there being a cover to complete the enclosure of the space inside the casing the receptacles having openings that are exposed on the outside of the casing for receiving two and three pronged electrical plugs for connection to the terminals; and at least one ground connector jack, distinct from said receptacles, for grounding an accessory electrical device not plugged into any of said receptacles, said at least one ground connector jack mounted in an aperture formed in the top of said casing adjacent a receptacle, and exposed on the outside of the casing for receipt of a grounding plug of an accessory device, said at least one ground connector jack electrically connected to the ground lead for the three wire conductor by as ground wire extending from said at least one jack to the ground lead at a location between adjacent receptacles.

2. A device as recited in claim 1 wherein said electrical outlet strip comprises a plurality of jacks, each disposed in an aperture in said casing top.

3. A device as recited in claim 2 wherein each of said plurality of jacks is connected to the ground lead by a ground wire extending from each of said jacks to the ground lead at locations between adjacent pairs of receptacles.

4. A device as recited in claim 3 wherein each of said jacks comprises a banana-type jack.

5. A device as recited in claim 4 further comprising circuitry means for sensing continuity to ground, said circuitry means operatively electrically connected to said electrical receptacles and said ground jacks, said circuitry means mounted within said casing.

6. A device as recited in claim 1 further comprising circuitry means for sensing continuity to ground, said circuitry means operatively electrically connected to said electrical receptacles and said at least one ground connector, said circuitry means mounted within said casing.

7. A device as recited in claim 5 further comprising a circuit breaker mounted within said casing, and having an actuator therefor extending outwardly from said casing, said circuit breaker for selectively connecting and interrupting the supply of electrical current to said receptacles from said three wire conductor.

8. A device as recited in claim 1 further comprising a circuit breaker mounted within said casing, and having an actuator therefor extending outwardly from said casing, said circuit breaker for selectively connecting and interrupting the supply of electrical current to said receptacles from said three wire conductor.

9. A multiple electrical outlet strip comprising:

a casing having a top with a number of apertures formed therein, inside and end walls to enclose a space, and an open side opposite the top, there being a cover to complete the enclosure of the space inside the casing;

a plurality of electrical outlet receptacles having live, neutral and ground terminals, the receptacles being adapted to be connected together into a parallel circuit;

each receptacle being received within an aperture in said casing top and having openings on one side thereof that are exposed on the outside of the casing for receiving two and three prong electrical plugs for connection said terminals;

a three wire conductor for carrying an electrical current to said casing, said connector having live, neutral and ground leads; and a plurality of ground jack means accessible from the exterior of the casing, for receiving ground connectors of electrical accessories not associated with any of said electrical plugs, said ground jack means operatively connected, within said casing, to the ground lead of said three wire conductor.

10. A device as recited in claim 9 wherein each of said ground jacks comprises a banana-type jack.

11. A device as recited in claim 9 further comprising a circuit breaker mounted within said casing, and having an actuator therefor extending outwardly from said casing, said circuit breaker for selectively connecting and interrupting the supply of electrical current to said receptacles from said three wire conductor.

12. A device as recited in claim 9 wherein each of said ground jack means is connected to the ground lead from the three wire conductor by a ground wire extending from the jack means to the conductor.

13. A device as recited in claim 12 wherein each ground said wire is connected to the ground lead at a location between adjacent receptacles.

14. A device as recited in claim 9 further comprising a circuitry means for sensing continuity to ground, said circuitry means operatively electrically connected to said electrical receptacles and said ground jacks, said circuitry means mounted within said casing.

15. A device as recited in claim 14 wherein each of said ground jacks is accessible from the top of said casing, extending through an aperture in said casing top, adjacent at least one of said electrical receptacles.

16. A device as recited in claim 14 wherein each of said ground jacks comprises a banana-type jack.

17. A device as recited in claim 16 further comprising a circuit breaker mounted within said casing, and having an actuator therefor extending outwardly from said casing, said circuit breaker for selectively connecting and interrupting the supply of electrical current to said receptacles from said three wire conductor.

18. A multiple electrical outlet strip comprising:

a plurality of electrical outlet receptacles, having live, neutral and ground terminals, the terminals of the electrical outlet receptacles being adapted to be connected into a parallel circuit;

a three wire conductor for carrying an electrical current to the outlet receptacles, the conductor having live, neutral and ground loads;

a casing, the casing having a top with apertures therein for receipt of said receptacles, and side and end walls to enclose a space into which the receptacles extend from the top, the casing having an open side opposite the top and there being a cover to complete the enclosure of the space inside the casing, the receptacles having openings that are exposed on the outside of the casing for receiving two and three pronged electrical plugs for connection to the terminals; and circuitry means for sensing continuity to ground, said circuitry means operatively electrically connected to said electrical receptalces, said circuitry means mounted within said casing.

19. A device as recited in claim 18 further comprising a circuit breaker mounted within said casing, and having an actuator therefor extending outwardly from said casing, said circuit breaker for selectively connecting and interrupting the supply of electrical current to said receptacles from said three wire conductor.

* * * * *